US005927247A

United States Patent [19]

Tanaka

[11] Patent Number: 5,927,247

[45] Date of Patent: Jul. 27, 1999

[54] DIRECT INJECTED ENGINE

[75] Inventor: Seiichi Tanaka, Hamamatsu, Japan

[73] Assignee: Sanshin Kogyo Kabushiki Kaisha, Hamamatsu, Japan

[21] Appl. No.: 08/938,247

[22] Filed: Sep. 26, 1997

[30] Foreign Application Priority Data

Sep. 26, 1996 [JP] Japan ..... 8-254496

[51] Int. Cl.[6] ..... F02D 41/14

[52] U.S. Cl. ..... 123/305; 123/73; 123/672

[58] Field of Search ..... 123/73 C, 305, 123/672, 703; 60/276

[56] References Cited

U.S. PATENT DOCUMENTS 4,984,540 1/1991 Morikawa ..... 123/73 C
5,682,870 11/1997 Motoyama ..... 123/703
5,713,325 2/1998 Yoshida et al. ..... 123/305 X
5,715,794 2/1998 Nakamura et al. ..... 123/305
5,727,536 3/1998 Kato ..... 123/682

*Primary Examiner*—Tony M. Argenbright
*Attorney, Agent, or Firm*—Knobbe, Martens, Olson & Bear LLP

[57] ABSTRACT

A two-cycle crankcase compression, direct injected internal combustion engine having several embodiments of feedback control systems. In each embodiment, the feedback control system includes at least one combustion condition sensor such as an oxygen sensor. The sensor is mounted, however, so that it communicates with the combustion gases through a sensor port that is disposed so that it will not receive fuel sprayed from the fuel injector. In one embodiment, the sensor port is positioned in a common portion of an exhaust manifold upstream of an exhaust control valve. In another embodiment, the sensor port is disposed directly in the cylinder but adjacent the injector so that the spray from the injector will be away from the sensor port.

12 Claims, 5 Drawing Sheets

DIRECT INJECTED ENGINE

BACKGROUND OF THE INVENTION

This invention relates to a direct injected engine and more particularly to an improved feedback control system and sensor positioning arrangement for a direct injected, two-cycle, internal combustion engine.

The advantages of two-cycle engines insofar as simplicity and high specific output are well-known. However, because of the scavenging system of such engines, it frequently is difficult to control the emission of constituents such as hydrocarbons. That is, in order to ensure good scavenging and high performance, it is frequently the case that fuel passes out of the exhaust port and gives rise to these problems. This characteristic is a result of the fact that the scavenging of the engine takes place during the end of the expansion stroke because of the fact that this type of engine fires every revolution of the crankshaft.

In order to provide more efficient emission control and better performance for two-cycle engines, it has been proposed to utilize either or both of direct cylinder fuel injection and feedback control using combustion condition sensors such as oxygen ($O_2$) sensors. Direct fuel injection permits more accurate control of the amount of fuel that is introduced into the cylinder and permits adjustment on a cycle-to-cycle basis. Oxygen or feedback control systems, permit relatively instantaneous response to variations from the desired air fuel ratio.

The problems with the combination of these two methodologies i.e., utilizing direct cylinder injection and feedback control is that the fuel sprayed by the injector may impinge upon the sensor and give erroneous readings. Thus, it is important that the sensor be located in such a way that it retains a representative sample of the combustion products and that it does not receive the direct spray of fuel from the injector.

It is, therefore, a principal object of this invention to provide an improved direct injected two-cycle internal combustion engine having feedback control.

It is a further object of this invention to provide an improved sensor-positioning arrangement for a two-cycle direct cylinder injected engine.

SUMMARY OF THE INVENTION

This invention is adapted to be embodied in a crankcase compression two-cycle internal combustion engine having a cylinder, cylinder head and piston that define a combustion chamber. At least one scavenge port delivers an air charge to the combustion chamber and at least one exhaust port discharges a burnt charge from the combustion chamber. A fuel injector is provided for injecting fuel directly into the combustion chamber. An exhaust passage extends from the exhaust port to the atmosphere for discharging the combustion products from the engine to the atmosphere. A combustion condition sensor is mounted in the engine and communicates with an area of the engine where the combustion products exist through a sensor port which is located in an area where it will not be exposed to direct fuel spray from the fuel injector and also where it will be directly contacted by the exhaust products.

DETAILED DESCRIPTION OF THE PREFERRED EMBODIMENTS OF THE INVENTION

Figure 1:
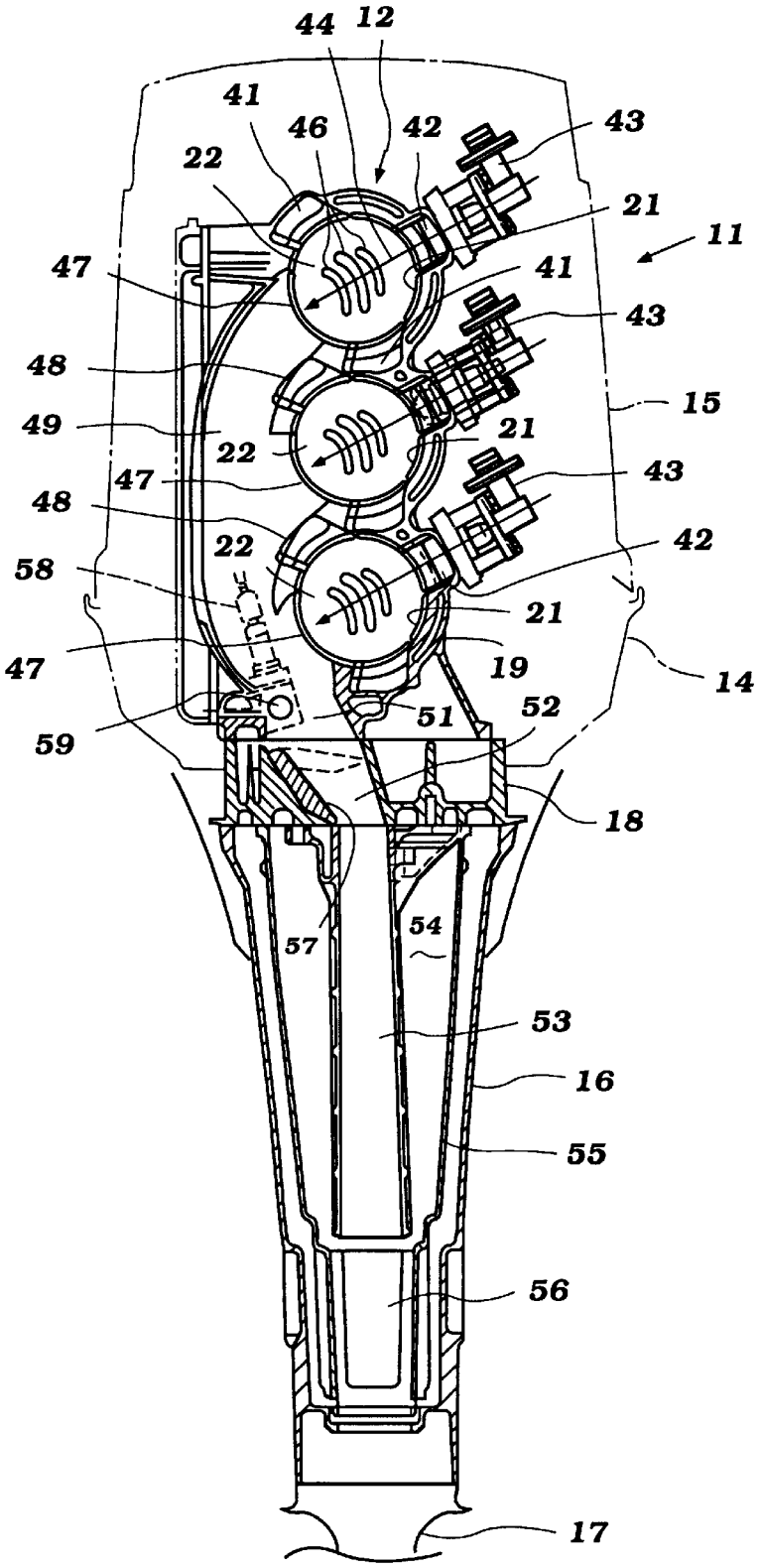
FIG. 1 is a view of an outboard motor embodying the invention with portions shown in phantom and other portions broken away and illustrated in cross-section.
Figure 2:
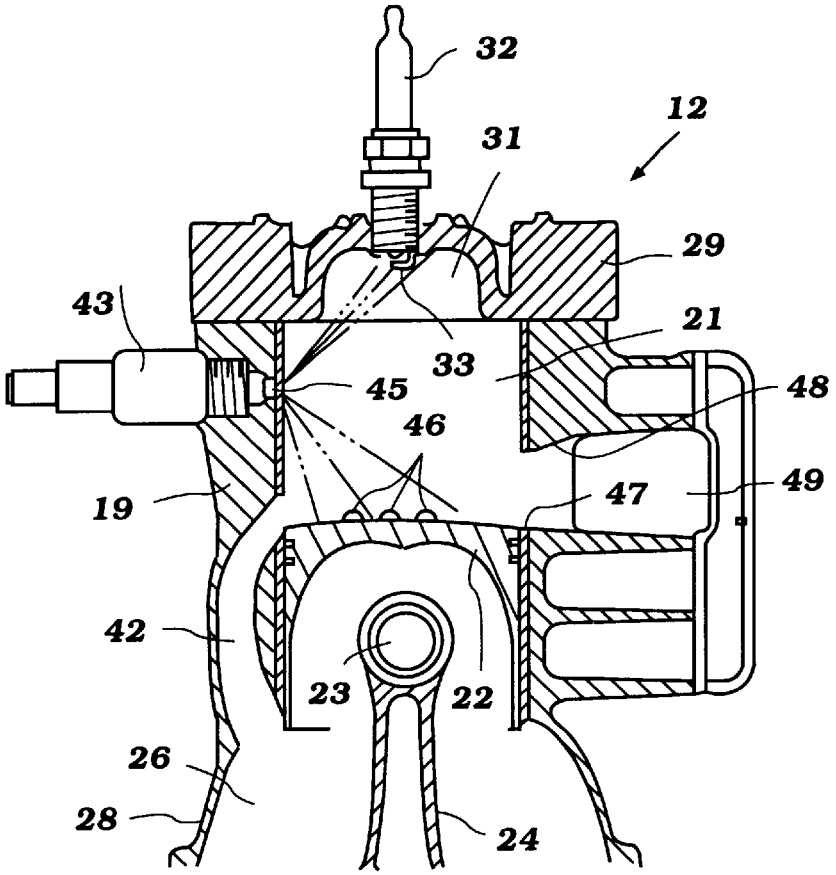
FIG. 2 is an enlarged cross-sectional view taken through one of the combustion chambers of the engine shown in FIG. 1 and depicts the fuel injector and combustion chamber in relationship to the piston.
Figure 3:
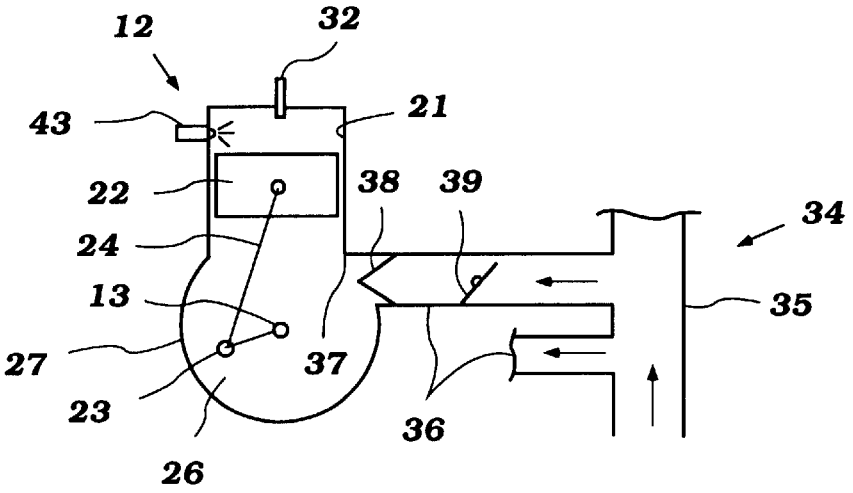
FIG. 3 is a schematic view of a single cylinder of the engine of this embodiment.

Referring first to the embodiment of FIGS. 1–3 and initially primarily to FIG. 1, an outboard motor constructed in accordance with this embodiment of the invention is shown partially and with parts shown in phantom so as to more clearly show the invention. The invention is described in conjunction with an outboard motor because outboard motors have a need for a high efficiency compact power unit and two-cycle crankcase compression engines fit this need very well. It will be readily apparent, however, to those skilled in the art how the invention can be utilized with other applications for two-cycle crankcase compression engines.

The outboard motor 11 includes a power head that consist of a powering internal combustion engine 12 which is mounted, as is typical with outboard motor practice, so that its crankshaft, shown schematically in FIG. 3 and indicated by the reference numeral 13, rotates about a vertically-disposed axis. This power head is completed by a protective cowling that is comprised of a lower tray portion 14 formed from an aluminum alloy or other similar rigid lightweight material. A main cowling member 15, formed from a molded fiberglass reinforced resin or the like is detachably connected to the tray 14 in any known manner so as to enclose the engine 12.

The vertical mounting of the rotational axis of the crankshaft 13 facilitates coupling of it to a drive shaft (not shown) that is journaled in a drive shaft housing 16 which depends from the aforenoted power head. A lower unit 17, which is shown only partially, formed at the lower portion of the drive shaft housing 16 carries a propulsion device of a known type such as a propeller that is driven by this drive shaft via a suitable transmission.

The engine 12 is mounted on the upper portion of the drive shaft housing by means of an exhaust guide 18.

Referring now additionally to FIGS. 2 and 3, the engine 12 in the illustrated embodiment is depicted as being of the three-cylinder in-line type. It will be readily apparent to those skilled in the art, however, how the invention can be utilized with a wide variety of other types of engines having varying cylinder numbers and cylinder configurations. The invention, however, does have some utility in conjunction with multiple cylinder engines wherein it is desired to utilize a single sensor for sensing the combustion conditions in a plurality of combustion chambers and this embodiment is typical of that type of construction.

The cylinders are formed within a cylinder block 19 formed from aluminum or an aluminum alloy and which forms three aligned, vertically-spaced cylinder bores 21. The cylinder bores 21 may be formed by liners that are pressed, cast or otherwise formed in the cylinder block 19.

Pistons 22 reciprocate in each of these cylinder bores 21. The pistons are connected by means of piston pins 23 to the upper or small ends of respective connecting rods 24. The lower or big ends of these connecting rods are joumaled on the throws 25 of the crankshaft 13. The crankshaft 13 is rotatably journaled in a suitable manner within a crankcase chamber 26 formed at the lower end of the cylinder block 19. This crankcase chamber may also be formed in part by a crankcase member 27 that is detachably connected to a skirt 28 of the cylinder block 19. As is typical with two-cycle crankcase compression engines, the crankcase chambers 28 associated with each of the cylinder bores 21 are sealed from each other.

A cylinder head assembly 29 is affixed to the cylinder block 19 in a known manner. This cylinder head assembly 29 is formed with individual recesses 31 that cooperate with the cylinder bores 21 and pistons 22 to defme the combustion chambers of the engine. Since, at top dead center position, each cylinder head recesses 31 form the major portion of the respective combustion chamber, the reference numeral 31 will also be utilized to designate the combustion chamber.

Spark plugs 32 are mounted in the cylinder head assembly 29 and have individual spark gaps 33 that protrude into the cylinder head recesses 31 for igniting the charge formed in the combustion chambers 31, in a manner which will be described later. The spark plugs 32 are fired by an appropriate ignition system which may be of any known type.

An air charge is delivered to the crankcase chambers 26 during upward movement of the pistons 22 in the cylinder bores 21. This is supplied by an air induction system shown schematically in FIG. 3 and indicated generally by the reference numeral 34.

As is typical with outboard motor practice, the protective cowling and specifically the main cowling portion 15 is provided with an atmospheric air inlet into which air can be drawn for combustion in the engine. This air is delivered to an air inlet device, shown schematically at 35 in FIG. 3 but which is shown in more detail in the figure showing the embodiment of FIGS. 4–8.

This air inlet device 35 delivers air to a plurality of runner sections 36 each of which leads to a respective intake port 37 formed in either the cylinder block skirt 28 or crankcase member 27 or both and communicating with the crankcase chambers 26. As is typical with two-cycle practice, read-type valves 38 are provided in each intake port 37 so as to permit the air to flow into the crankcase chamber 26 when the piston 22 is moving upwardly and to preclude reverse flow when the piston 22 moves downwardly.

Throttle valves 39 are provided in each of the intake runners 36 for controlling the speed of the engine 12 in a well-known manner. These throttles 39 are operated by a suitable throttle control mechanism. This is not shown in this embodiment but will be described in more detail by reference later to the embodiment of FIGS. 4–8 where it is shown in detail.

The air charge which has been drawn into the crankcase chambers 26 during the upward movement of the pistons 22 is compressed as the pistons 22 move downwardly in the cylinder bores 21. This compressed charge is then transferred to the combustion chamber 31 through a scavenge passage arrangement that is comprised of a pair of side main scavenge passages 41 and a center scavenge passage 42. The scavenge passages 41 and 42 are rotated slightly as seen in FIG. 1 so as to permit the spacing between the cylinder bores 21 to be minimized and to reduce the overall length of the engine without sacrificing scavenging efficiency.

As the pistons 22 finish their downward movement and begin to move upwardly, this transferred charge will be further compressed in the combustion chambers 31.

Fuel injectors, indicated by the reference numeral 43, are mounted in the cylinder block 19 in a position so that their spray axis lies on a line, indicated at 44 in FIG. 1 and which extends diametrically across the cylinder bore. The fuel injectors 43 have their spray nozzle portions 45 disposed so as to spray a portion of the fuel upwardly toward the spark gap 33 and a portion downwardly toward the head of the piston 22.

Fuel is supplied to the fuel injectors 43 through a suitable fuel supply system and this includes a high-pressure delivery system having a fuel rail that cooperates with the injectors 43 for delivering fuel thereto. The fuel rail may include a pressure regulating valve that controls fuel pressure by dumping it back toward the source so as to maintain a uniform or the desired pressure of fuel for the injectors 43. This structure is alshown in more detail in FIGS. 4–8 and will be described later.

The injectors 43 may be of any known type and can include solenoid-operated valves that control the opening and closing of the injector port 43.

By mounting the injectors 43 so that their nozzles 45 are in the cylinder bore 21 and low enough therein to be covered by the piston 22 when the spark plug 33 is fired, lower cost injectors can be employed and the injectors 43 will be shielded from the high heat and temperature that could otherwise damage them during the initial phase of combustion.

The heads of the piston 22 are provided with a plurality of raised ribs 46 which, in this embodiment, are curved along the line 44 and which provide an additional surface area on which fuel may collect from the injector nozzle 45. By providing a larger surface area, this fuel can evaporate due to the heat of the piston and improve fuel vaporization during the small time before combustion.

When the spark plug 32 are fired by closing a charge to jump the gap 33, the charge will ignite and burn driving the pistons 22 downwardly.

Eventually, they will open exhaust ports 47 formed in the cylinder block 19. These exhaust ports 47 communicate with individual runners 48 of an exhaust manifold that also has a collector section 49 in which the exhaust gasses are collected and delivered downwardly. The lower end of this exhaust manifold 49 has a discharge end 51 that cooperates with an exhaust passage 52 formed in the exhaust guide 18.

An exhaust pipe 53 is affixed to the lower end of the exhaust guide 18 and delivers the exhaust gasses to an expansion chamber 54 formed by an inner shell 55 of the drive shaft housing 16. These exhaust gasses are thus silenced.

The exhaust gases then are delivered downwardly through a passage 56 to an underwater exhaust gas discharge of known type. In addition, the system may be provided with an above-the-water exhaust gas discharge for permitting discharge of exhaust gasses at low speeds and when the underwater discharge is deeply submerged and gas pressure is low. This type of construction is well known in the art and further description of it is not believed to be necessary to permit those skilled in the art to practice the invention.

An exhaust control valve 57 is mounted in the exhaust guide 18 to control the effective flow area of the passage 52 and to obtain the desired tuning effect for the exhaust system. Various control strategies, which are not relevant to the invention, may be employed for this purpose.

Finally, the control for the engine includes an oxygen (02) sensor, indicated by the reference numeral 58. In this embodiment, the oxygen sensor is mounted so as to communicate with the exhaust manifold passage 51 adjacent but upstream of the exhaust control valve 57 through a sensor port 59. The sensor 58 may be of any known type and by communicating through the sensor port 59 it will be ensured that a representative exhaust sample from all cylinders will be received. Also, the sensor port 59 is far removed from the injector nozzles 45 so that it is ensured that fuel will not impinge upon it.

The actual control strategy utilized for controlling the fuel injectors 43, firing of the spark plugs 32 and control of the exhaust valve 57 as well as the timing of beginning of fuel injection by the injectors 43 and the injection duration can be of any known type. However, because of the location and positioning of the oxygen sensor 58 and its communication through the sensor port 59, accurate information can be utilized for this control.

FIGS. 4–8 show another embodiment of the invention which is generally the same as the previously-described embodiment. For that reason, when components of this embodiment are the same or substantially the same as those of the previously-described embodiment, they have been identified by the same reference numerals and will be described again only insofar as is necessary to under the construction and operation of this embodiment. This embodiment, however, also shows further details of the outboard motor and those further details will be described first.

Figure 4:
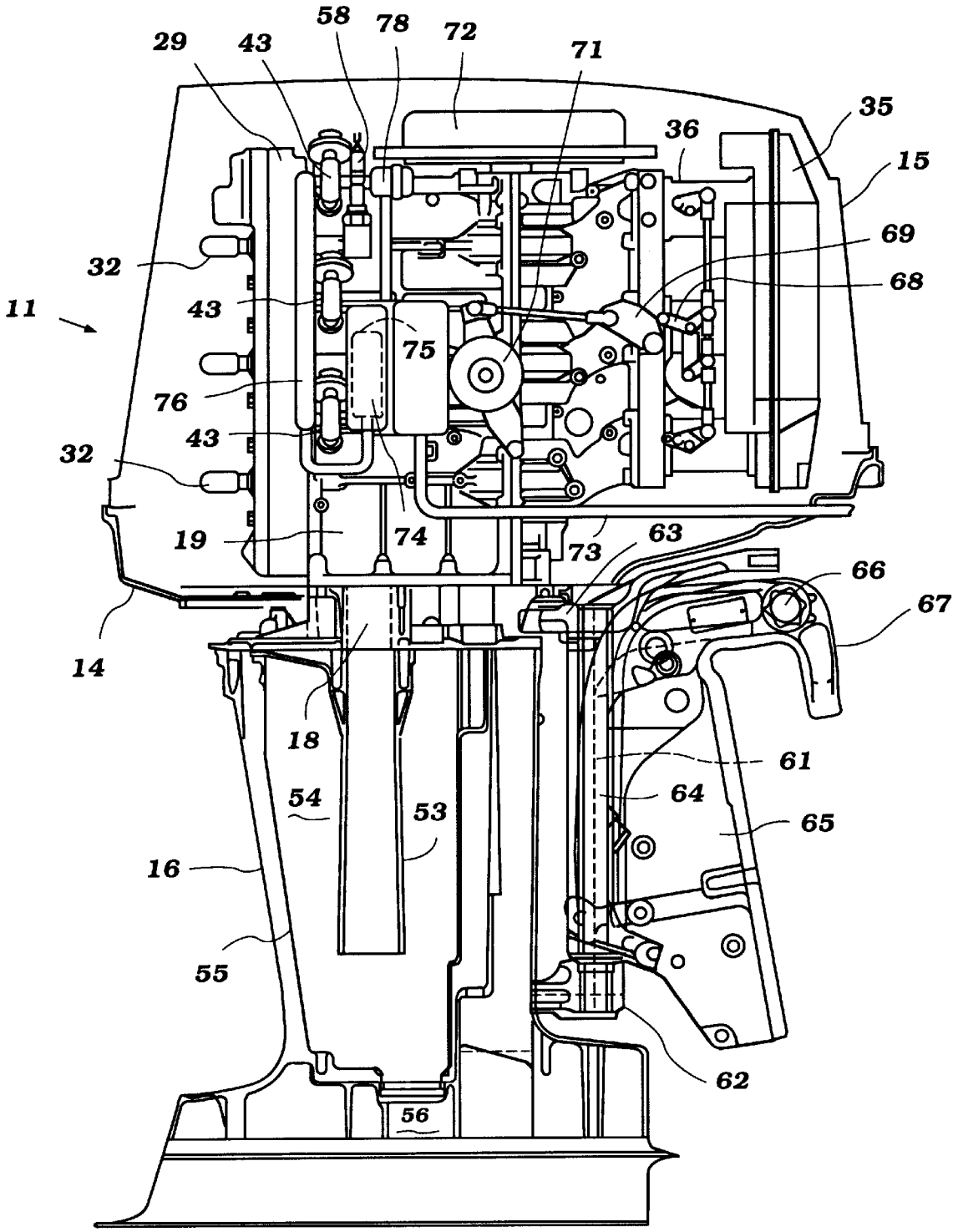
FIG. 4 is a partial side elevational of an outboard motor constructed in accordance with another embodiment of the invention, with portions shown in phantom and other portions broken away and shown in cross-section.

Referring primarily to FIG. 4, the outboard motor includes a steering shaft 61 that is connected to the drive shaft housing 16 by a lower bracket 62 and an upper bracket 63. This steering shaft 61 is joumaled for steering movement within a swivel bracket 64. This steering movement permits steering of the outboard motor 11 in a manner well-known in this art.

The swivel bracket 64 is, in turn, connected to a clamping bracket 65 by means of a pivot pin 66 for tilt and trim movement of the outboard motor 11 as is also well-known in the art. The clamping bracket 65 includes a clamping device 67 for detachable connection an associated watercraft.

This embodiment, as previously noted, also shows the air inlet device 35 in more detail. Also illustrated is the throttle mechanism for synchronizing the movement of the throttle valves 39 associated with each air inlet runner 36. This throttle mechanism includes an interconnecting, synchronizing linkage assembly 68 of any known type which is operated by means of a throttle cam 69. The throttle cam 69 is, in turn, operated by a main control lever 71 mounted on the side of the cylinder block 19 in a well-known manner. This lever 71 is operated by a remote actuator, as is known in this art.

It has also been previously noted that the spark plugs 32 are fired by a suitable ignition system. This includes a magneto generator driven off of a flywheel 72 mounted on the upper end of the crankshaft 25.

Also, the details of the fuel supply system are shown in this figure. These include a fuel supply line 73 that receives fuel from a remote source and delivers it to a vapor separator assembly 74 mounted on the side of the cylinder block 19. This vapor separator assembly includes an internal high-pressure fuel pump 75 that delivers fuel to the aforenoted fuel rail which is shown in this figure and indicated by the reference numeral 76.

This fuel rail 76 has branch portions 77 that are associated with each of the injectors 43 for delivering fuel to them. At the end of the fuel rail 76, there is provided a pressure control valve 78 that controls the maximum pressure, as aforenoted, by dumping fuel back to the system preferably into the vapor separator assembly 74.

Again, this description of the basic components of the outboard motor 11 is just typical of the types of construction with which the invention can be utilized.

Figure 7:
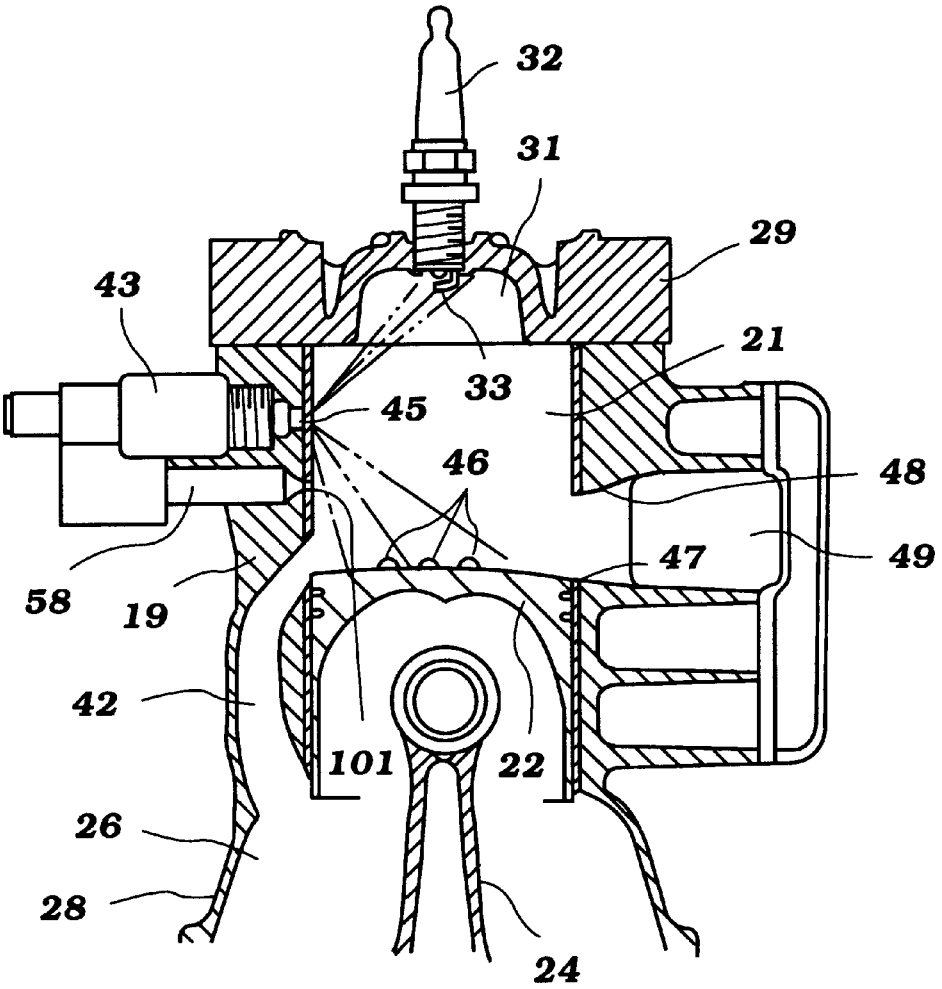
FIG. 7 is a cross-sectional view, in part similar to that of FIG. 2, but showing the single cylinder of this embodiment in cross-section.
Figure 8:
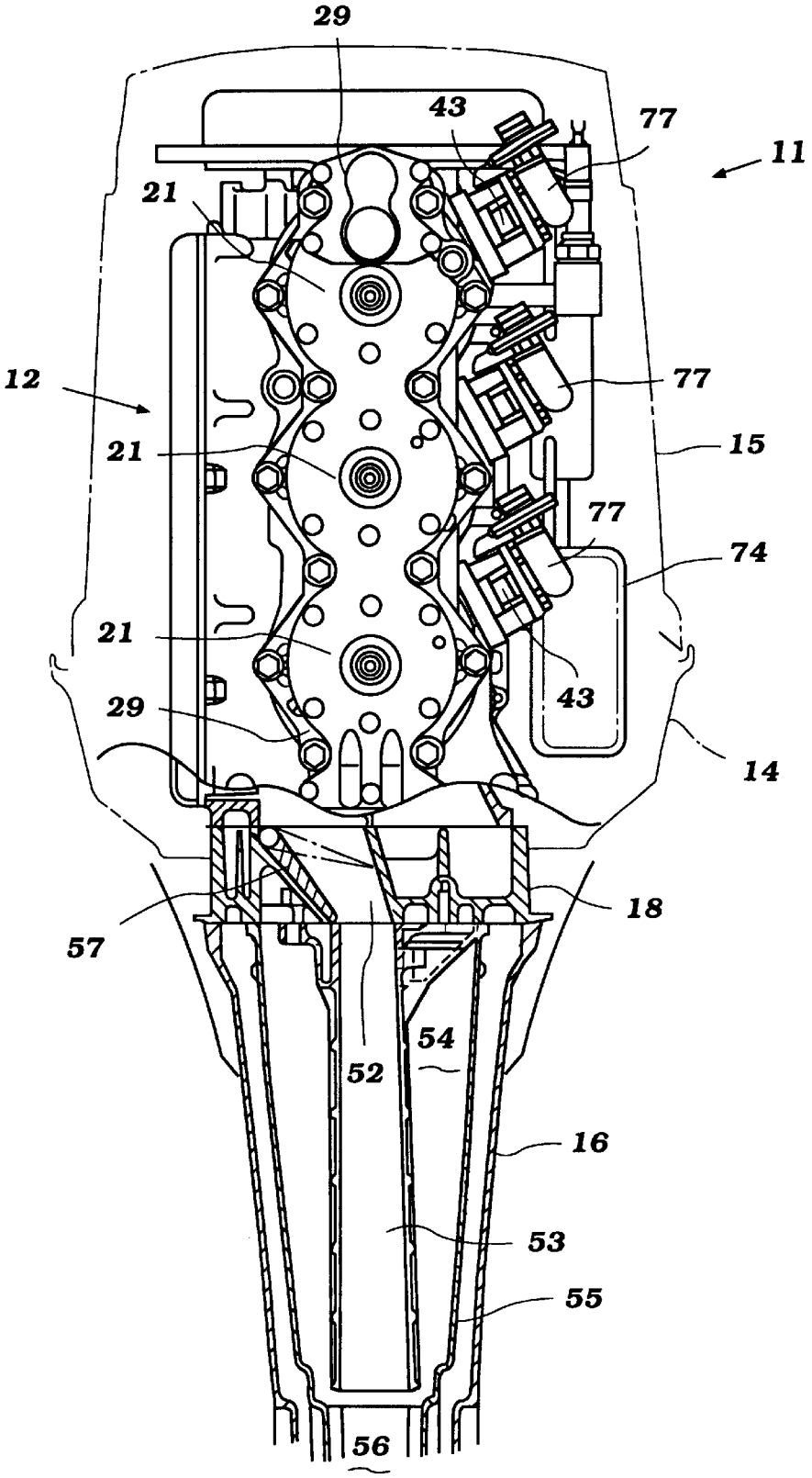
FIG. 8 is a view looking in a direction perpendicular to that of FIG. 4 and primarily from the rear of the engine, with a portion of the protective cowling shown in phantom and other portions of the engine and outboard motor broken away and shown in cross-section.

Referring specifically to FIG. 7 and also shown in FIGS. 4 and 8, there is provided an oxygen sensor 58 for each of the cylinder bores 21. This oxygen sensor 58 communicates with the cylinder bores through sensor ports 101 that are positioned immediately below the discharge nozzles 45 of the fuel injectors and immediately above the scavenge ports 42.

Thus, even though being mounted in proximity to the injectors, the fuel sprayed by them will be sprayed away from the sensor port 101. Also, the scavenging flow from the scavenge passage 42 will drive the fuel away from the ports 101 and thus it will be assured that fuel cannot reach the sensor 58.

Figure 5:
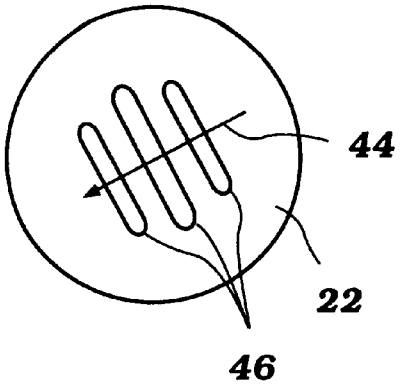
FIG. 5 is a top plan view showing one form of piston head configuration that can be utilized with either embodiment.
Figure 6:
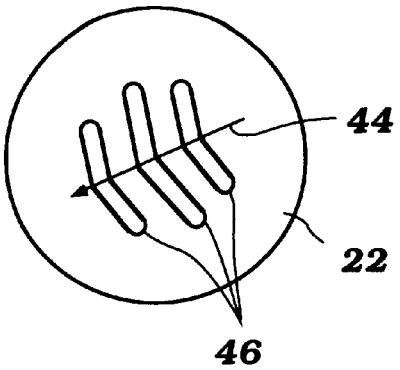
FIG. 6 is a top plan view of another piston head construction that can be utilized with either embodiment.

FIGS. 5 and 6 show alternative arrangements for configuring the piston projections 46 to achieve the aforenoted function for them.

Thus, it will be seen that this embodiment also provides very accurate combustion sensing capabilities and permits the sensing for each cylinder so that the cylinders can be independently controlled. Also, from the foregoing description it should be readily apparent that the described embodiments of the invention provide a very effective sensor positioning arrangement for a two-cycle direct injected engine. Of course, the various embodiments shown are those preferred forms which the invention can take, but various changes and modifications may be made without departing from the spirit and scope of the invention as defined by the appended claims.

I claim:

1. A two-cycle crankcase compression internal combustion engine comprised of a cylinder, a cylinder head and a piston defining a combustion chamber, at least one scavenge passage entering into said combustion chamber through a scavenge port from a crankcase chamber for delivering a scavenging air flow thereto through said scavenge port, at least one exhaust port for discharging exhaust gases from said combustion chamber, a fuel injector for injecting fuel directly into said combustion chamber, said fuel injector spraying fuel into said combustion chamber in a pattern defined by a spray axis with the fuel particles diverging outwardly from said spray axis into and across said combustion chamber, an exhaust manifold for collecting exhaust gases from said exhaust port and discharging them to the atmosphere, a spark plug for firing a charge in said combustion chamber, and a control system for controlling the timing and duration of injection of fuel from said fuel injector and the timing of firing of said spark plug, said control system including a combustion condition sensor for sensing the air/fuel ratio in said combustion chamber and a sensor port formed within said combustion chamber for communicating said combustion condition sensor with the burnt charge, said sensor port being disposed in an orientation that does not lie within the periphery of an area within said combustion chamber that is circumscribed by the path of the fuel particles issuing around said spray axis within said combustion chamber to sample the combustion products without receiving fuel sprayed from said fuel injector.

2. A two-cycle crankcase compression internal combustion engine as set forth in claim 1, wherein the fuel injector is mounted in the cylinder and is covered during at least a portion of the engine cycle by the piston.

3. A two-cycle crankcase compression internal combustion engine as set forth in claim 2, wherein the sensor port is disposed in the cylinder adjacent the fuel injector.

4. A two-cycle crankcase compression internal combustion engine as set forth in claim 3, wherein the scavenge port is disposed adjacent the sensor port.

5. A two-cycle crankcase compression internal combustion engine as set forth in claim 1, wherein the engine has a plurality of cylinders and there is provided a combustion condition sensor and sensor port for each cylinder.

6. A two-cycle crankcase compression internal combustion engine as set forth in claim 5, wherein each fuel injector is mounted in the respective cylinder and is covered during at least a portion of the engine cycle by the respective piston.

7. A two-cycle crankcase compression internal combustion engine as set forth in claim 6, wherein each sensor port is disposed in the cylinder adjacent the fuel injector.

8. A two-cycle crankcase compression internal combustion engine as set forth in claim 7, wherein the scavenge port is disposed adjacent the sensor port.

9. A two-cycle crankcase compression internal combustion engine as set forth in claim 8, wherein the scavenge port is disposed adjacent the sensor port and the sensor port is between the fuel injector and the scavenge port.

10. A two-cycle crankcase compression internal combustion engine comprised of a cylinder, a cylinder head and a piston defining a combustion chamber, at least one scavenge passage entering into said combustion chamber through a scavenge port from a crankcase chamber for delivering a scavenging air flow thereto through said scavenge port, at least one exhaust port for discharging exhaust gases from said combustion chamber, a fuel injector for injecting fuel directly into said combustion chamber, an exhaust system including an exhaust manifold for collecting exhaust gases from said exhaust port and discharging them to the atmosphere, a spark plug for firing a charge in said combustion chamber, and a control system for controlling the timing and duration of injection of fuel from said fuel injector and the timing of firing of said spark plug, said control system including a combustion condition sensor for sensing the air/fuel ratio in said combustion chamber and a sensor port for communicating said combustion condition sensor with the burnt charge, said sensor port being disposed in said exhaust system in an orientation to sample the combustion products without receiving fuel sprayed from said fuel injector, said exhaust system including an exhaust control valve for controlling the effective area of the exhaust system, said sensor port being disposed in said exhaust system contiguous to but upstream of said exhaust control valve.

11. A two-cycle crankcase compression internal combustion engine as set forth in claim 10, wherein the engine has a plurality of cylinders and wherein the sensor port is disposed in an area where the exhaust gases from all of the cylinders are merged.

12. A two-cycle crankcase compression internal combustion engine as set forth in claim 11, wherein the fuel injector is mounted in the cylinder and is covered during at least a portion of the engine's cycle by the piston.

* * * * *